United States Patent [19]

Krauss et al.

[11] Patent Number: 4,666,088

[45] Date of Patent: May 19, 1987

[54] FUEL INJECTION VALVE

[75] Inventors: Rudolf Krauss, Stuttgart; Rudolf Sauer, Benningen, both of Fed. Rep. of Germany

[73] Assignee: Robert Bosch GmbH, Stuttgart, Fed. Rep. of Germany

[21] Appl. No.: 601,403

[22] Filed: Apr. 17, 1984

[30] Foreign Application Priority Data

Mar. 28, 1984 [DE] Fed. Rep. of Germany ..... 3411337

[51] Int. Cl.[4] ..... F02M 61/08

[52] U.S. Cl. ..... 239/533.12; 239/498; 239/585

[58] Field of Search ..... 239/533.1–533.12, 239/585, 601, 600, 591, 602, 589, 498, 268, 591, 390, 436, 600

[56] References Cited

U.S. PATENT DOCUMENTS

| | | | |
|---|---|---|---|
| 621,480 | 3/1899 | Stevens | 239/601 |
| 2,040,846 | 5/1936 | Hesselman | 239/600 X |
| 2,775,482 | 12/1956 | Schutz | 239/498 X |
| 3,361,161 | 1/1968 | Schwartz | 239/585 X |
| 3,567,135 | 3/1971 | Gebert | 239/585 |
| 3,687,375 | 9/1970 | Griffiths | 239/557 |
| 3,782,639 | 1/1974 | Boltz et al. | 239/533.12 X |
| 4,057,190 | 11/1977 | Kiwior et al. | 239/585 X |
| 4,421,278 | 12/1983 | Kienzle et al. | 239/585 X |
| 4,498,626 | 2/1985 | Pitchford | 239/600 X |
| 4,527,744 | 7/1985 | Hafner et al. | 239/591 X |
| 4,566,634 | 1/1986 | Wiegand | 239/410 |

FOREIGN PATENT DOCUMENTS

| | | | |
|---|---|---|---|
| 1189117 | 4/1970 | United Kingdom | 239/533.2 |

*Primary Examiner*—Andres Kashnikow
*Assistant Examiner*—Kevin Patrick Weldon
*Attorney, Agent, or Firm*—Edwin E. Greigg

[57] ABSTRACT

A fuel injection valve which serves to inject fuel into the intake tube of internal combustion engines. The fuel injection valve includes a valve housing, in which a nozzle body having a valve seat is firmly held. Downstream of the valve seat, the fuel is directed via metering fuel guide bores to a preparation bore, which is continued in the form of a preparation bore in an injection sheath. The injection sheath is held on the nozzle body by means of an adapter body surrounding and engaging the nozzle body, and it has an ejection segment within which the inside diameter of the preparation bore decreases in the flow direction toward the ejection end. Teeth are also provided on the ejection segment, pointing toward the ejection end.

7 Claims, 3 Drawing Figures

FUEL INJECTION VALVE

BACKGROUND OF THE INVENTION

The invention is based on a fuel injection valve for a mixture-compressing internal combustion engine. A fuel injection valve is already known in which the fuel to be injected is ejected downstream of a valve seat via a preparation bore. In this valve it is possible for relatively large fuel droplets to form at the end of the preparation bore and reach the intake tube of the internal combustion engine, resulting in a non-uniform fuel supply to the individual cylinders of the engine and hence in rough engine operation.

OBJECT AND SUMMARY OF THE INVENTION

The fuel injection valve according to the invention has the advantage over the prior art of avoiding the formation of relatively large fuel droplets, so that fuel ejection is accomplished uniformly. A uniform supply of fuel to the individual cylinders of the engine and smooth engine operation are thereby assured.

Advantageous features and embodiments of the fuel injection valve have been disclosed herein. It is particularly advantageous to form the ejection segment with approximately four to eight teeth.

A further particularly advantageous feature of the invention is to form the ejection segment on an injection sheath, which makes it possible to dispose the ejection point as close as possible to the most favorable point in the intake tube without any loss in preparation, even if the fuel injection valve is in an oblique position of up to 45° of inclination.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
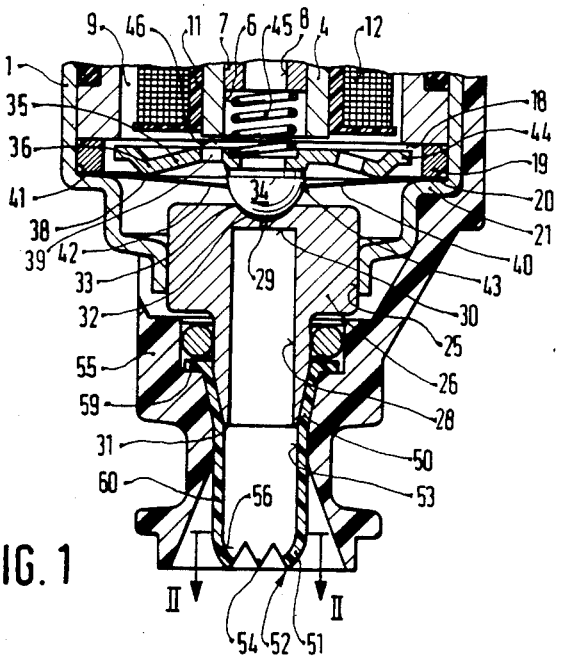
FIG. 1 shows a first exemplary embodiment of a fuel injection valve according to the invention.

FIG. 1 shows, as an example of a valve, the fuel injection valve for a fuel injection system, which serves for example to inject fuel into the intake tube of mixture-compressing internal combustion engines having externally supplied ignition. A valve housing 1 is manufactured by some chip-free shaping process such as deep drawing, rolling or the like. A fuel fitting 4 embodied as a connection fitting is inserted sealingly into the housing 1; being fabricated of ferromagnetic material, this fuel fitting 4 simultaneously acts as the inner core of the electromagnetically actuated valve. The fuel fitting 4, which extends concentrically with the valve shaft, has an inner bore 6 into which an adjusting sheath 7 having a through bore 8 is pressed. The end of the fuel fitting 4 that protrudes out of the valve housing 1 not shown communicates with a source of fuel, for instance a fuel distributor line. The other end of the fuel fitting 4 protrudes into an inner chamber 9 of the valve housing 1 and bears an insulating carrier body 11, which at least partially encompasses a magnetic coil 12. A spacer ring 19 rests against the end face 18 of the valve housing 1 and is adjoined by a guide diaphragm 20. The other side of the guide diaphragm 20 is engaged by a stepped collar 21 of the valve housing 1, so that an axial tensioning force is thereby provided for the positional fixation of the spacer ring 19 and the guide diaphragm 20. The valve housing 1 has a coaxial reception bore 25 of reduced diameter, in which a nozzle body 26 is inserted and secured for instance by welding or soldering. The nozzle body 26 has a preferably cylindrical preparation bore 28 in the form of a blind bore, at least one fuel guide bore 29 is formed in the bore bottom 30 which serves to discharge a metered fuel. The discharging of the fuel through the guide bore 29 at the bore bottom 30 of the preparation bore 28 is preferably such that the flow of fuel into the preparation bore 28 is not at a tangent; instead, the fuel stream initially emerges from the fuel guide bores 29 without touching the wall, and subsequently the fuel strikes the wall of the preparation bore 28 and is distributed over this wall in the form of a film of approximately parabolic shape, and flows toward the nozzle body end 31. The fuel guide bores 29 extend such that they are inclined relative to the valve axis, and they begin in a spherical section chamber 32 embodied in the nozzle body. Downstream of this spherical section chamber 32, a curved valve seat 33 is embodied in the nozzle body 26, cooperating with a valve element 34 embodied as a semi-spherical shaped ball. In order to attain the smallest possible idle volume, the volume of the spherical section chamber 32 should be as small as possible when the valve element 34 is resting on the valve seat 33.

Remote from the valve seat 33, the valve element 34 is joined to a flat portion of an armature 35, for instance by soldering or welding. The armature 35 may be embodied as a stamped or pressed part and may for instance have an annular guide ring 36, which is embodied in a raised or convex manner and rests on an annular guide zone 38 of the guide diaphragm 20 on the side of the guide diaphragm 20 remote from the valve seat 33. Flow-through openings 39 in the flat armature 35 and flow recesses 40 in the guide diaphragm 20 enable fuel to flow unhindered through armature 35 and the guide diaphragm 20. The guide diaphragm 20, which is fastened at its outer circumference at a fastening zone 41 such that it is firmly attached to the housing between the spacer ring 19 and the collar 21, has a centering zone 42 which encloses a centering opening 43 through which the movable valve element 34 protrudes and is thereby centered in the radial direction. The firm fastening of the guide diaphragm 20 to the housing between the spacer ring 19 and the collar 21 is effected in a plane which, when the valve element 34 is resting on the valve seat 33, the diaphragm 20 passes along, or as close as possible to, the center point of the ball-like valve element. By means of the guide zone 38 of the guide diaphragm 20 engaging the guide ring 36 of the armature 35, the armature 35 is guided as nearly parallel as possible to the end face 18 of the valve housing 1, beyond which the armature partially protrudes, with an outer action zone 44. A compression spring 45 is guided in the inner bore 6 of the fuel fitting 4 which extends almost to the armature 35. On one end, the compression spring 45 engages the armature 35 and on the other end the spring 45 engages the adjusting sheath 7, and the spring tends to urge the valve element 34 in the direction toward the valve seat 33. The fuel fitting 4 acting as an inner core is advantageously inserted into the valve housing 1 to such an extent that between its end face 46 oriented toward the flat armature 35 and the armature 35 itself, a small air gap still exists even when the magnetic coil 12 is excited, and the armature 35 comes to rest with its outer action zone 44 against the end face 18 of the valve housing 1. On the other hand, when the magnetic coil 12 is not excited, the armature 35 assumes a position in which an air gap is likewise formed between the end face 18 and the action zone 44 of the armature. As a result, adhesion of the armature to the inner core is avoided. The magnetic circuit extends outside via the valve housing 1 and inside via the fuel fitting 4, closing via the armature 35.

Figure 2:
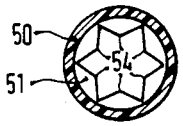
FIG. 2 is a section taken along the line II—II of FIG. 1.

An injection sheath 50 is pushed onto the nozzle body end 31 and has an ejection segment 51 remote from the nozzle body 26. The ejection segment 51 ends in an ejection end 52. The first preparation bore 28 of the nozzle body 26 continues in a second preparation bore 53 of the injection sheath 50, and the second preparation bore 53 may be the same or larger in its inside diameter than the first preparation bore 28. The ejection segment 51 of the injection sheath 50 extends at an inclination inward toward the ejection end 52 in such a manner that the inside diameter of the third preparation bore 56 in the ejection segment 51 decreases in the flow direction toward the ejection end 52 of the injection segment 51; that is, it becomes smaller relative to the inside diameter of the second preparation bore 53. The wall of the ejection segment 51 may extend inward in conical fashion, by way of example, or in a curved manner as shown in FIG. 1. In addition, approximately four to eight teeth 54, pointing toward the ejection end 52, are embodied in the ejection segment 51. In FIG. 2, an ejection sheath 50 having six teeth 54 is shown. The injection sheath 50 may be fastened firmly to the nozzle body 26 by means of an adapter body 55 encompassing and engaging the nozzle body 26. The injection sheath 50 enables shifting of the ejection point 52, if necessary, to a favorable point in the intake tube of the engine without a preparation loss. Minimally sized fuel droplets forming constantly on the wall are constantly carried along with the fuel stream toward the inwardly pointing teeth 54 because of the embodiment of the injection sheath 50 in accordance with the invention; thus relatively large fuel droplets have no opportunity to form, and a uniform supply of fuel to the individual engine cylinders is assured. By means of the injection sheath according to the invention, very good fuel preparation is assured even if the fuel injection valve is in an oblique position of up to 45°.

Naturally the nozzle body end 31 of the nozzle body 26 may itself be embodied in a shape corresponding to the ejection segment 51 of the injection sheath 50, although this possibility is not illustrated herein.

Figure 3:
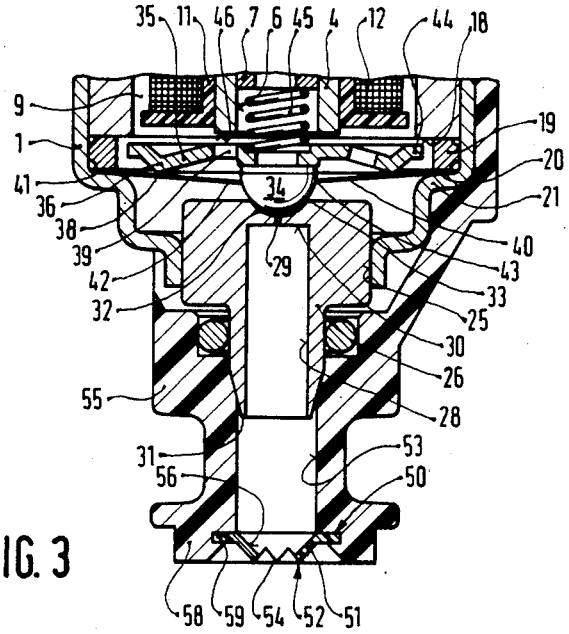
FIG. 3 shows a second exemplary embodiment of a fuel injection valve according to the invention.

In the second exemplary embodiment of a fuel injection valve shown in FIG. 3, a second preparation bore 53 continuous with the preparation bore 28 of the nozzle body 26 is formed directly in the adapter body 55. The injection sheath 50 is disposed on the end 58 of the adapter body 55 remote from the nozzle body 26, concentrically with the first and second preparation bores 28, 53. The injection sheath 50 may then be embodied either on the adapter body 55 itself or it may be injected or clamped into the adapter body 55, which is fabricated of rubber or plastic, by means of a collar 59. In FIG. 3, the injection sheath 50 is shown comprising only a collar 59 and the ejection segment 51, while in another form of embodiment the injection sheath 50 may be embodied, as shown in FIG. 1, with an extension segment 60, which may extend between the collar 59 and the ejection segment 51. The manner in which the injection sheath 50 shown in FIG. 3 functions is the same as that already described in connection with FIGS. 1 and 2.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection valve comprising a nozzle body, a valve seat on said nozzle body, said nozzle body including a first preparation bore, at least one fuel guide bore extending from said valve seat to said first preparation bore, an ejection segment, a second preparation bore, said second preparation bore beginning at said nozzle body downstream of said valve seat, said second preparation bore terminating remote from said valve seat in a region of said ejection segment, a third preparation bore in said ejection segment, the inside diameter of said second preparation bore is constant in an axial direction to a region of said third preparation bore and the inside diameter of said third preparation bore in the ejection segment decreases in the flow direction toward an ejection end in said ejection segment, the cross section of the third preparation bore decreases in the vicinity of said ejection segment and said ejection segment includes inclined axially directed teeth formed by a continuous jagged flow line which point toward the ejection end in a manner such that tips of the teeth form said ejection end.

2. A fuel injection valve as defined by claim 1, characterized in that the ejection segment is embodied on an injection sheath.

3. A fuel injection valve as defined by claim 2, characterized in that the injection sheath is embodied downstream on the nozzle body.

4. A fuel injection valve as defined by claim 3, characterized in that the injection sheath is firmly fastened to the nozzle body by an adapter body surrounding and engaging the nozzle body.

5. A fuel injection valve as defined by claim 2, characterized in that the injection sheath is disposed on an adapter body surrounding and engaging the nozzle body.

6. A fuel injection valve as defined by claim 2, characterized in that the injection sheath is embodied on an adapter body surrounding and engaging the nozzle body.

7. A fuel injection valve as defined by claim 1, characterized in that at least four teeth are embodied on the ejection segment.

* * * * *